United States Patent [19]

Schubert

[11] Patent Number: 4,774,881

[45] Date of Patent: Oct. 4, 1988

[54] ROTARY OPERATED CHARACTER SELECTION SYSTEM FOR POSTAGE METERS

[75] Inventor: Keith E. Schubert, W. Norwalk, Conn.

[73] Assignee: Pitney Bowes Inc., Stamford, Conn.

[21] Appl. No.: 39,823

[22] Filed: Apr. 15, 1987

Related U.S. Application Data

[63] Continuation of Ser. No. 778,655, Sep. 23, 1985, abandoned.

[51] Int. Cl.[4] ..... B41J 7/34

[52] U.S. Cl. ..... 101/91; 101/110

[58] Field of Search ..... 101/91, 110; 400/110, 400/203

[56] References Cited

U.S. PATENT DOCUMENTS

| | | | |
|---|---|---|---|
| 3,353,480 | 11/1967 | Lowell et al. | 101/91 |
| 3,573,589 | 4/1971 | Berry | 101/91 |
| 3,738,261 | 6/1973 | Ritzerfeld | 101/91 |
| 4,078,484 | 3/1978 | Horbal et al. | 101/91 |
| 4,287,825 | 9/1981 | Eckert, Jr. et al. | 101/91 |
| 4,367,676 | 1/1983 | Clark | 101/91 |
| 4,520,725 | 6/1985 | Hang | 101/110 |
| 4,603,627 | 8/1986 | Pollak, Jr. et al. | 101/91 |

FOREIGN PATENT DOCUMENTS

| | | | |
|---|---|---|---|
| 17406 | 10/1980 | European Pat. Off. | 101/91 |
| 891265 | 9/1953 | Fed. Rep. of Germany | 101/91 |

*Primary Examiner*—William Pieprz

*Attorney, Agent, or Firm*—Charles G. Parks, Jr.; David E. Pitchenik; Melvin J. Scolnick

[57] ABSTRACT

Rotary operated character selection apparatus is provided for postage meters having a rotating print drum and at least one print wheel in the drum for printing a selected character on an envelope or label. One set of print wheels may be provided for value selection, and another set of print wheels may be provided for date selection. The print wheels are turned by rotating print wheel gears, located adjacent an opening in an outside surface of the drum, by rotating the drum to a preselection position to engage the print wheel gear with a mating gear located outside of the drum, and rotating the mating gear until the proper print wheel character is selected. Devices are provided to determine the rotational angle of the drum and the positions of the print wheels, and an appropriate control system is provided, preferably with an input keyboard for selecting the value of postage to be dispensed and printed, and the date.

2 Claims, 5 Drawing Sheets

ROTARY OPERATED CHARACTER SELECTION SYSTEM FOR POSTAGE METERS

This application is a continuation of application Ser. No. 778,665, filed 9/23/85, now abandoned.

This invention relates to postage meter character selection systems, and more particularly to postage meter character selection systems which are rotary operated.

BACKGROUND OF THE INVENTION

It is inconvenient and sometimes impractical for people who regularly mail many pieces of mail to use postage stamps. As a result, postage meters have been developed which can be installed in a home or office. Such postage meters dispense value in the form of postage printed on a mail piece such as an envelope, or on a label which may be affixed to a mail piece. Such meters have means for selecting a value of postage, setting a date, and printing the value and date on an envelope or label.

Postage for such meters is generally purchased in advance. At the time of purchase, the meter is adjusted internally to dispense the total amount of postage purchased in any combination of increments which is desired. Accounting apparatus in the postage meter calculates how much postage the machine has dispensed, and how much additional postage has been paid for but not used.

Postage is dispensed in desired increments by printing a selected postage value, the date, and one or more symbols on an envelope, label or the like. The value and date are selected by rotating a series of print wheels to desired characters before the postage is dispensed.

Printing is usually accomplished by passing the envelope or label along a flat feeding surface. At the proper time, a clutch is released and a rotatable drum makes one revolution. The envelope passes between the drum and the feeding surface as the drum rotates, and the print wheels, which are in the drum, print the desired information on the envelope or the like.

In order to maintain security and control of the postage meters, government regulations prohibit manufacturers of postage equipment from selling the meters, and require that the meters be leased. However, other apparatus which is used with postage meters such as automatic feeding devices, weighing scales and the like, may be sold to customers. As a result, most manufacturers of postage equipment make postage meters which include a drum, print wheels for selecting the postage value and date, accounting apparatus and certain other things, and postage machines which include the feeding surface, automatic feeding apparatus, if any, and other features. The postage meters and postage machines are designed so that the postage meter may be easily separated from the postage machine and removed.

Since the postage meters can only be leased, and not sold, manufacturers must recover the cost of the meters over a period of time. Obviously, manufacturers prefer to recover such costs in as short a time as possible, which creates a need to reduce the cost of postage meters.

In recent years, some manufacturers of postage equipment have considered replacing certain mechanical apparatus with electronically controlled hardware. For example, in U.S. Pat. No. 4,287,825, mechanical levers for setting the print wheels are replaced with servo motors. Since some electronic devices are relatively expensive, the conversion from mechanical to electrical systems in some cases has increased, rather than decreased the cost of the postage meter. Thus, there is also a need to reduce the cost of postage meters when replacing mechanical apparatus with electronics.

In known postage meters, the selection of postage values is made by moving a series of levers back and forth. In most cases, there are four such levers. Each lever has ten fixed positions which correspond to digits on an operatively connected print wheel.

Each lever turns a gear or the like which is operatively connected to a linear rack. If there are four levers, four racks will be provided. The racks are placed in recesses in the drum shaft and extend into the drum, where mechanisms are provided which translate the linear motion of the racks into a rotary motion which turns the respective print wheels to the proper characters when the levers are moved.

Due to the linear motion of the racks, the operator selecting values must move the levers extensively to change the selected digit in some cases. For example, the levers must substantially move from one end of travel to the opposite end of travel in order to change the selected digit from 0 to 9, from 1 to 9, and so forth, even though those digits are adjacent to each other or nearly adjacent to each other on the print wheel. This is inefficient and causes unnecessary wear on parts. Thus, there is a need for character selection systems for postage meters which operate over the shortest path between points on the print wheel.

Accordingly, an object of this invention is to provide new and improved postage meters.

Another object is to provide new and improved postage meter character selection systems, including value selection systems and date selection systems.

Still another object is to provide new and improved character selection apparatus for postage meters which reduces the cost of the meter.

A still further object is to provide new and improved character selection apparatus for postage meters which reduces the cost of the meter when electronics replace mechanical apparatus.

Yet another object is to provide new and improved character selection apparatus for postage meters which uses the shortest path between characters on a print wheel during the character selection process.

SUMMARY OF THE INVENTION

In keeping with one aspect of this invention, rotary operated character selection apparatus is provided for postage meters and the like. The postage meters have a rotating print drum and a plurality of print wheels in the drum for printing selected characters on an envelope or label. In most cases, one set of print wheels is provided for value selection, and another set of print wheels is provided for date selection. When the drum rotates through a print cycle, the date and a selected value of postage are printed on an envelope or label.

The character selection apparatus includes a plurality of print wheel gear mechanisms in the drum for turning a respective print wheel to print the selected character. A print wheel gear mechanism may be provided for each print wheel, so that each wheel may be operated independently.

Each print wheel gear mechanism includes a gear which is located adjacent to an opening in an outside suface of the drum. The print wheel gear is turned by first rotating the drum to a predetermined position so that the print wheel gear engages a mating gear located outside of the drum, and then rotating the mating gear until the desired print wheel character is selected. Encoders and decoders are provided to determine the rotational angle of the drum and the print wheels, and an appropriate control system is provided to control the drum and the print wheels so that desired values are selected and dates are set in response to operator commands. Many components of the control system may be located outside of the postage meter, if desired, to reduce costs. The drum and the mating gear are turned by motors which may also be located outside of the meter, to further reduce costs.

In operation, when proper instructions are provided to the control system, the control system prepares to print a desired value or date by rotating the drum for engagement of the mating gear with a selected print wheel gear. The control system then causes the mating gear to rotate as required to select the desired character on the print wheel. The control system may cause the mating gear to rotate in whichever direction will result in the shortest movement of the print wheel. When the desired character on the print wheel is selected, the drum is rotated to other print wheel gears, as required, to complete the process of character selection.

BRIEF DESCRIPTION OF THE DRAWINGS

The above mentioned and other features of an embodiment of this invention and the manner of obtaining them will become more apparent, and will be best understood by reference to the following description, taken in conjunction with the accompanying drawings in which.

DETAILED DESCRIPTION

Figure 1:
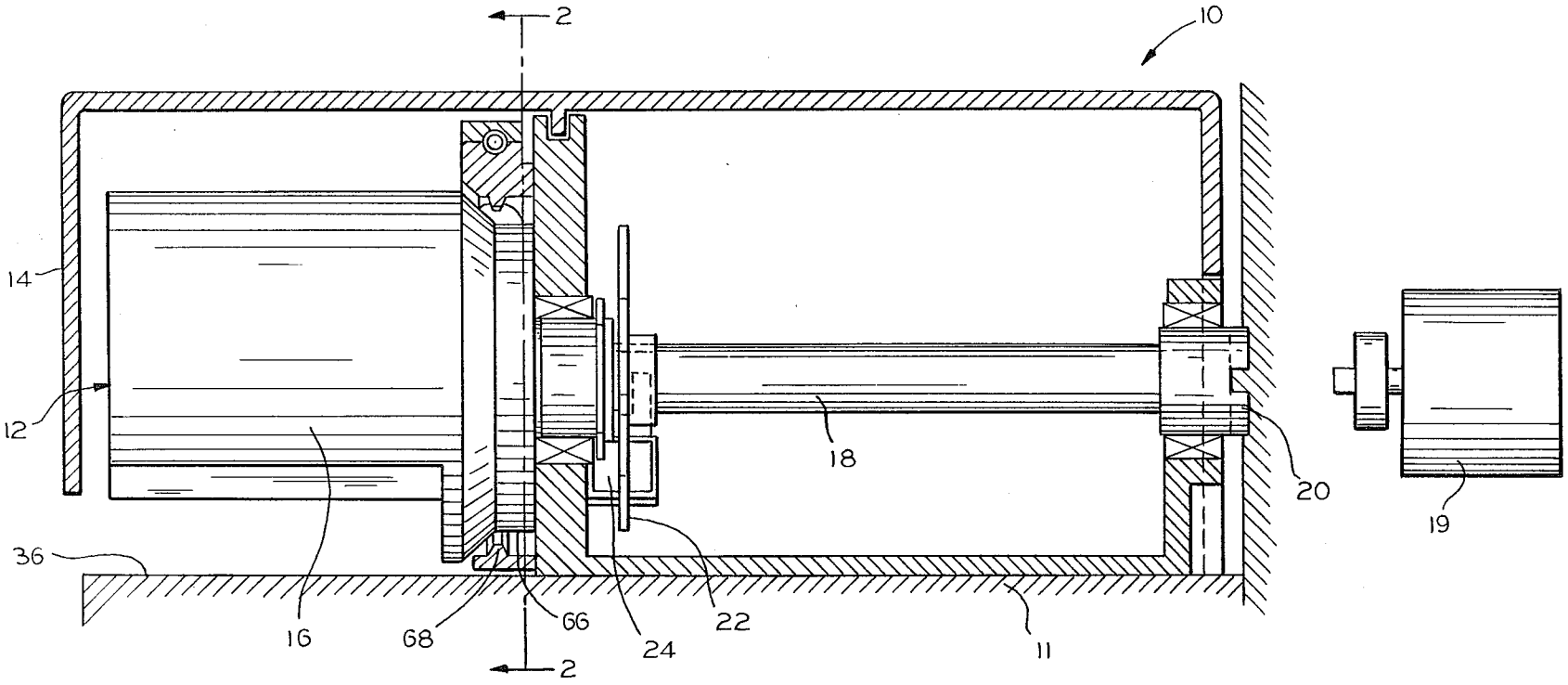
FIG. 1 is a side elevation view of a postage meter which includes character selection apparatus in accordance with an embodiment of the invention.

FIG. 1 shows a postage meter 10. The postage meter 10 operates in conjunction with a postage machine 11 (partially shown) to dispense value in the form of postage printed on a mail piece such as an envelope, or on a label which may be affixed to a mail piece. The postage meter 10 and postage meter 11 function together, but the postage meter 10 may be easily removed from the postage machine 11, if desired. The postage machine 11 may provide a base and a power source for the postage meter 10, and may include various other features, such as an automatic feed system and the like. The postage machine 11 may be sold to customers, but the postage meter 10 may only be leased, due to government regulations.

The postage meter 10 (FIG. 1) includes a drum portion 12 inside a case 14. The drum portion 12 includes a rotatable drum 16 secured to a shaft 18. The shaft 18 and drum 16 may be rotated to selected positions by a drum stepper motor 19 which is operatively connected to a drive key 20 during operation. The motor 19 is a stepper motor or the like, and may be located outside of the postage meter in the postage machine, if desired, to reduce the cost of the postage meter and recover the cost of the stepper motor through the sale of the postage machine.

The position of the drum 16 may be identified by an encoder disk 22 which is secured to the shaft 18 to rotate with the drum 16, and a drum decoder 24 which is secured to the case 14. The encoder 22 includes holes or other information for identifying selected positions of the drum 16, and the decoder 24 may include one or more optical detectors or the like which produce predetermined electrical signals indicative of the position of the encoder 22 and drum 16.

Figure 2:
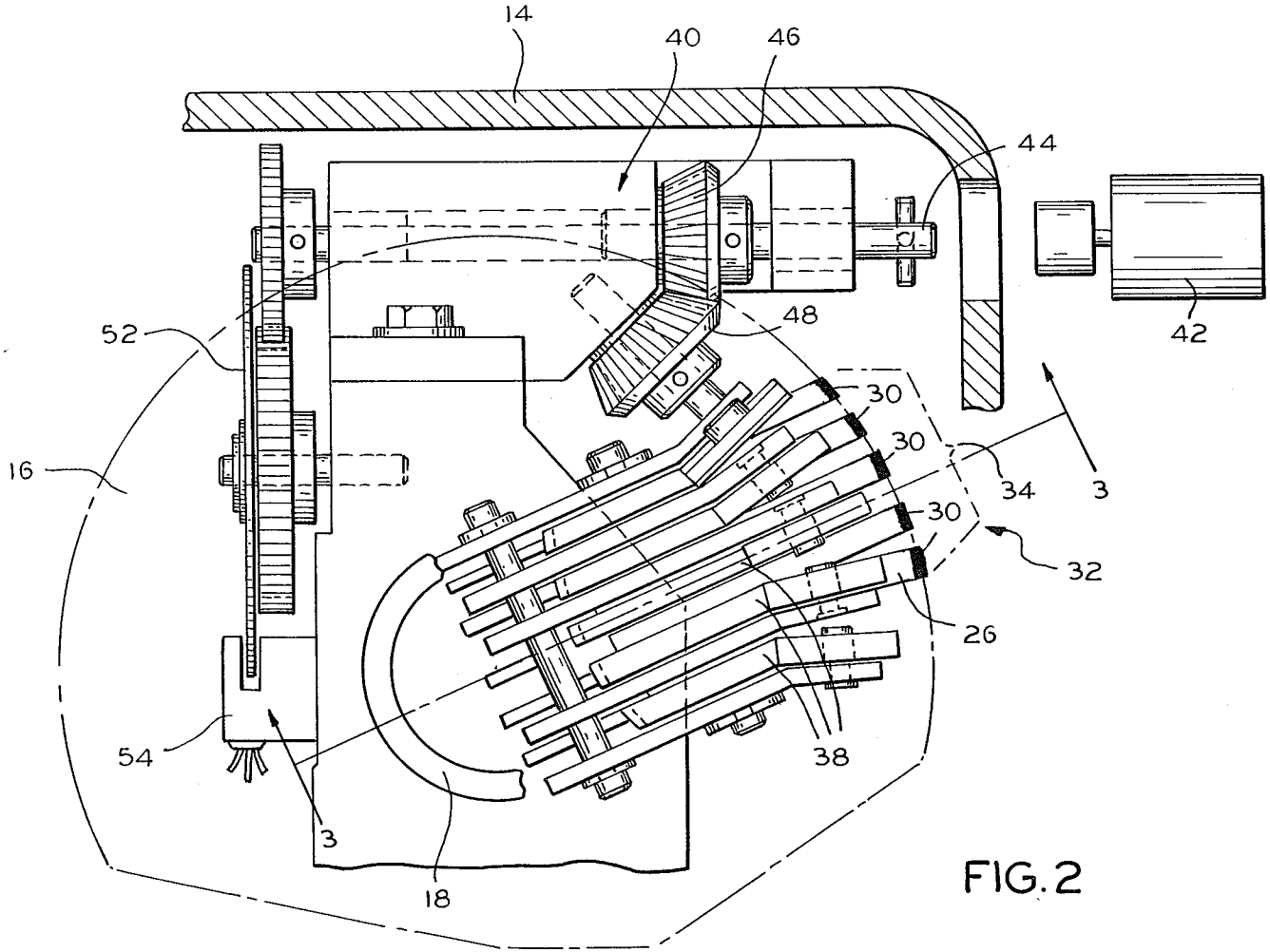
FIG. 2 is a sectional elevation view of the apparatus of FIG. 1, taken along lines 2—2, showing a value selection system made in accordance with this embodiment of the invention.
Figure 3:
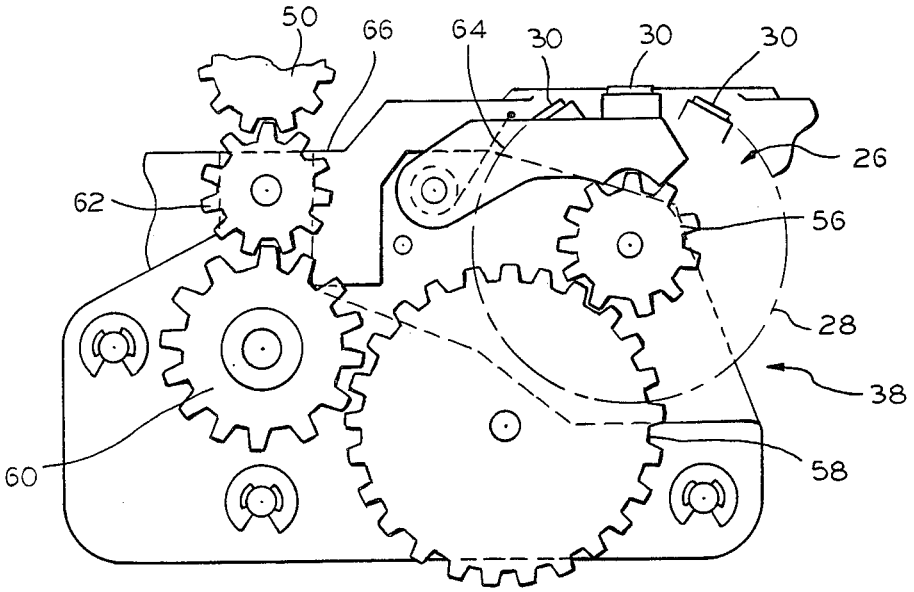
FIG. 3 is a sectional view of the value selection apparatus of FIG. 2, taken along lines 3—3.
Figure 4:
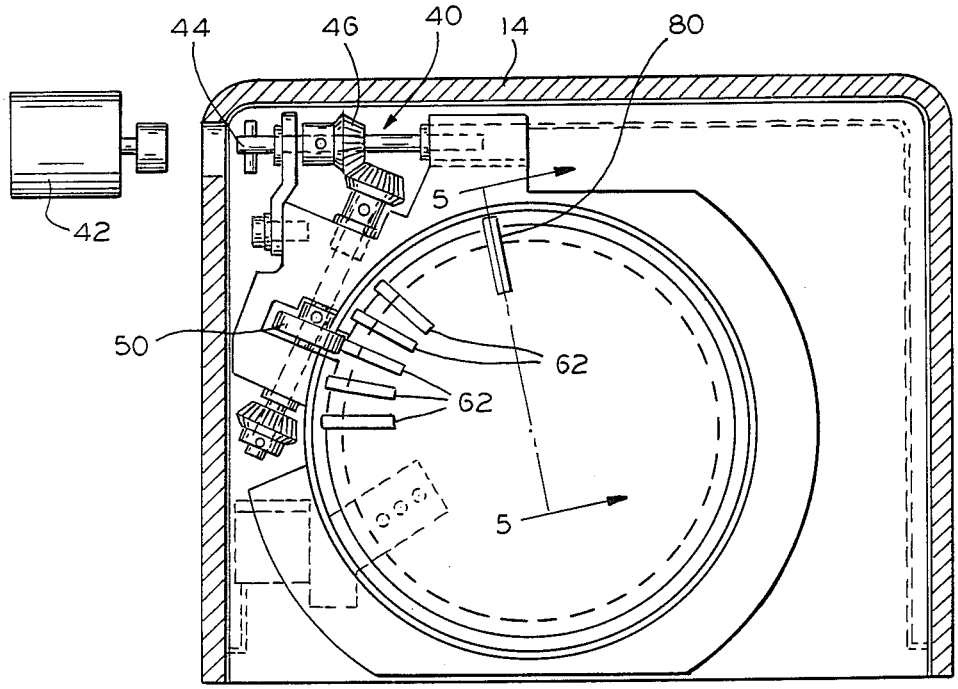
FIG. 4 is a sectional view of the apparatus of FIG. 1, taken along lines 2—2, showing a value selection system and a date selection system made in accordance with an embodiment of this invention.
Figure 6:
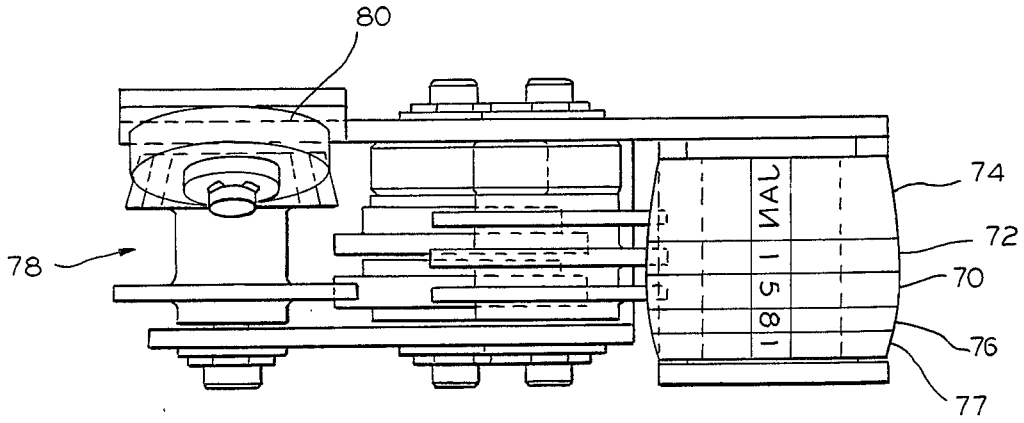
FIG. 6 is a top plan view of the apparatus of FIG. 5.
Figure 5:
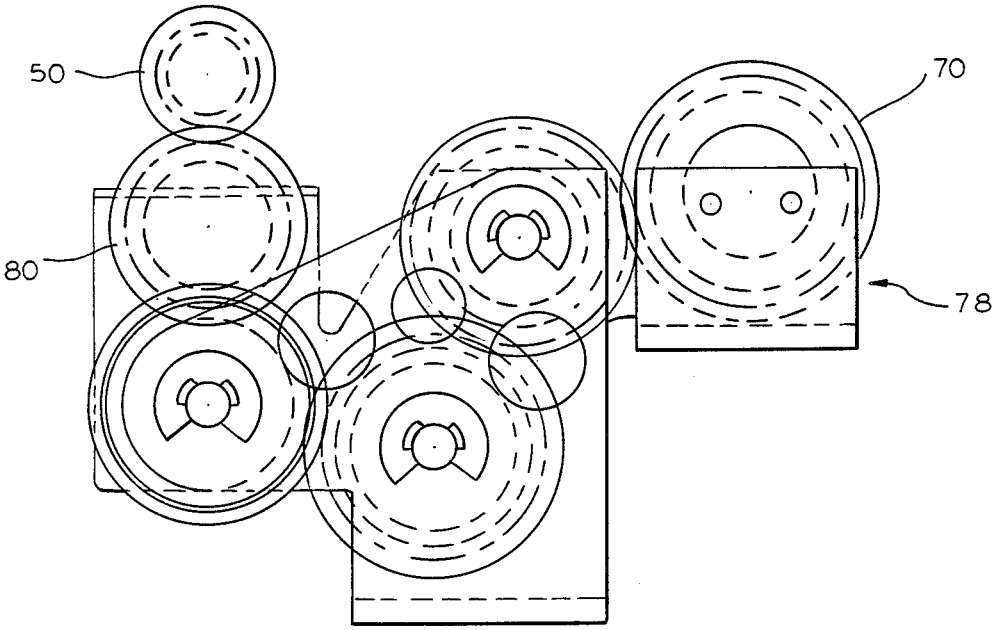
FIG. 5 is a sectional view of the date selection apparatus of FIG. 4, taken along lines 5—5.

Character selection apparatus is shown which may be used to select discrete characters to be printed, such as postage values, as shown in FIGS. 2, 3 and 4, or dates, as shown in FIGS. 4, 5 and 6. The characters are on known print wheels 26 (FIGS. 2 and 3), each having a generally axial outside surface 28 and a plurality of characters 30 in discrete positions on the surface 28.

Referring to FIG. 2, value selection apparatus 32 includes a set 34 of print wheels 26 rotatably secured in the drum 16 so that one of the characters 30 on each of the print wheels 26 may be printed on a surface such as an envelope, label or the like which is passed between the drum 16 and a feed surface 36 (FIG. 1) on the machine 11 as the drum 16 rotates through a print cycle. It is contemplated that the stepper motor 19 could rotate the drum 16 through its print cycle, if desired, or a different type of motor could be used for that purpose.

The characters 30 (FIG. 2) on the print wheels 26 are consecutive numbers from 0 to 9 which may be rotated to print any value between 000.00 (for test purposes) and 999.99. A dollar sign or other monetary symbol may be printed by a printing plate which is not shown.

The apparatus 32 also includes a plurality of print wheel gear mechanisms 38 which are operatively connected to the print wheels 26 for turning the print wheels 26 so that a desired character will be printed when the drum 16 rotates through its print cycle. Each print wheel gear mechanism 38 is connected to only one print wheel 26, and each print wheel gear mechanism 38 operates independently of the other print wheel gear mechanisms 38 in the apparatus 32.

A mating gear mechanism 40 (FIG. 2) is secured in the case 14 adjacent to the drum 16 for operative engagement and control of any selected print wheel gear mechanism 38 when the drum 16 is rotated to a proper position and held in place. The mating gear mechanism 40 includes a stepper motor 42, which is preferably located in the postage machine 11, outside of the meter 10, to further reduce the cost of the meter 10. The mating gear mechanism 40 also includes a shaft 44 which is adapted to be turned by the stepper motor 42, a gear 46 secured to the shaft 44, a gear 48 which is turned by the gear 46, and a mating gear 50 which is controlled by the gear 48.

An indexing or encoder wheel 52 is operatively connected to the shaft 44 so that the wheel 52 rotates in a known relationship with respect to the mating gear 50. The wheel 52 includes holes or other information for identifying the position of the mating gear 50.

A decoder 54, such as one or more optical detectors or the like, is secured to the meter 10 to decode the information contained in the wheel 52 and produce predetermined electrical signals which are related to the position of the mating gear 50.

Each print wheel gear mechanism 38 includes gears 56, 58, and 60, and print wheel gear 62, constructed as shown in FIG. 3, and may include a spring-loaded latch 64 for securing the print wheel 26 in place when the wheel 26 is to be held in a fixed position, while permitting the wheel 26 to turn when desired.

The print wheel gears 62 extend through an opening in a wall 66 (FIGS. 1 and 3) in an outside surface of the drum 16 so that when a selected print gear 62 is aligned with the mating gear 50, the mating gear 50 can turn the selected print wheel gear 62, adjusting the print wheel 26 which is associated with the selected print wheel gear 62.

Referring again to FIG. 1, a print wheel gear lock 68 is provided which prevents the gears 62 and print wheels 26 from moving when the drum 16 rotates through its print cycle. The print wheel gear lock 68 is in the form of a ring which surrounds most of the drum 16, but does not inhibit the operation of the mating gear 50.

The set 34 of print wheels 26 may have characters corresponding to various dates, if desired, and the apparatus 32 may be used to select a desired date to be printed by the postage meter 10 when postage is dispensed. It is probable that in such circumstances two print wheel sets 34 would be included, one for selecting a value, and the other for selecting a date.

If the print wheel set 34 were used for date selection, the print wheels might appear with characters such as those seen in FIG. 6. A first print wheel 70 having characters from 0 to 9, for each ones digit of each day of a month, and a second print wheel 72 having at least one character 0 (or a blank), 1, 2 and 3, for each tens digit of each possible day of a month. A third print wheel 74 has a character for each month of the year, such as Jan., Feb., and so forth, and a fourth print wheel 76 and a fifth print wheel gear 77 have characters for years, such as 85, 86 and so forth.

It would not be necessary to provide print wheel gear mechanisms 38 for each of the dater print wheels 70, 72, 74, 76 and 77, although that is contemplated. It is also possible to only provide print wheel gear mechanisms 38 for the first and second print wheels 70, 72 and operate the wheels 74, 76 and 77 manually or in some other manner, or to provide print wheel gear mechanisms 38 for the first, second and third print wheels 70, 72 and 74, and operate the fourth and fifth print wheels 76 and 77 manually or otherwise.

The date selection print wheels 70, 72, 74, 76 and 77 may be operated by a number of print wheel gear mechanisms 38, as just described, or in the manner shown in FIGS. 5 and 6. A single dater print wheel gear mechanism 78, which is similar to the print wheel gear mechanisms 38 previously described, is operatively connected to the first print wheel gear. The gear mechanism 78 includes a dater print wheel gear 80 which extends through an opening in the wall 66 of the drum 16 for operative engagement with the mating gear 50, as shown in FIG. 5. The second print wheel 72 is operatively connected to the first print wheel 70 for advancement of the second print wheel 72 by the first print wheel 70 when the first print wheel 70 moves from 9 to 0 (or a blank) or from a blank to 0. (If the print wheel 70 has twelve positions, which is likely since the wheel 74 must have twelve positions for the months of the year, two positions will be blank.)

If desired, the third print wheel 74 may be operatively connected to the second print wheel 72 for advancement of the third print wheel 74 by the second print wheel 72 when the second print wheel 72 moves from 3 to 0 (or a blank). If the second print wheel 72 has twelve positions, it may have three sets of the characters 0 (or a blank), 1, 2 and 3. A gear having four spaced teeth may be turned with the second print wheel 72, and the four-toothed gear may be engaged with a twelve-toothed gear which rotates the third print wheel 74 (showing months). In this manner, the four-toothed gear will only turn the third print wheel 74 when the second print wheel 72 moves from a 3 to a 0 (or a blank).

The fourth and fifth print wheels 76 and 77 (showing the year) could be operatively connected to the third print wheel 74, if desired, but they could also be operated manually, since they need only be changed annually.

Figure 7:
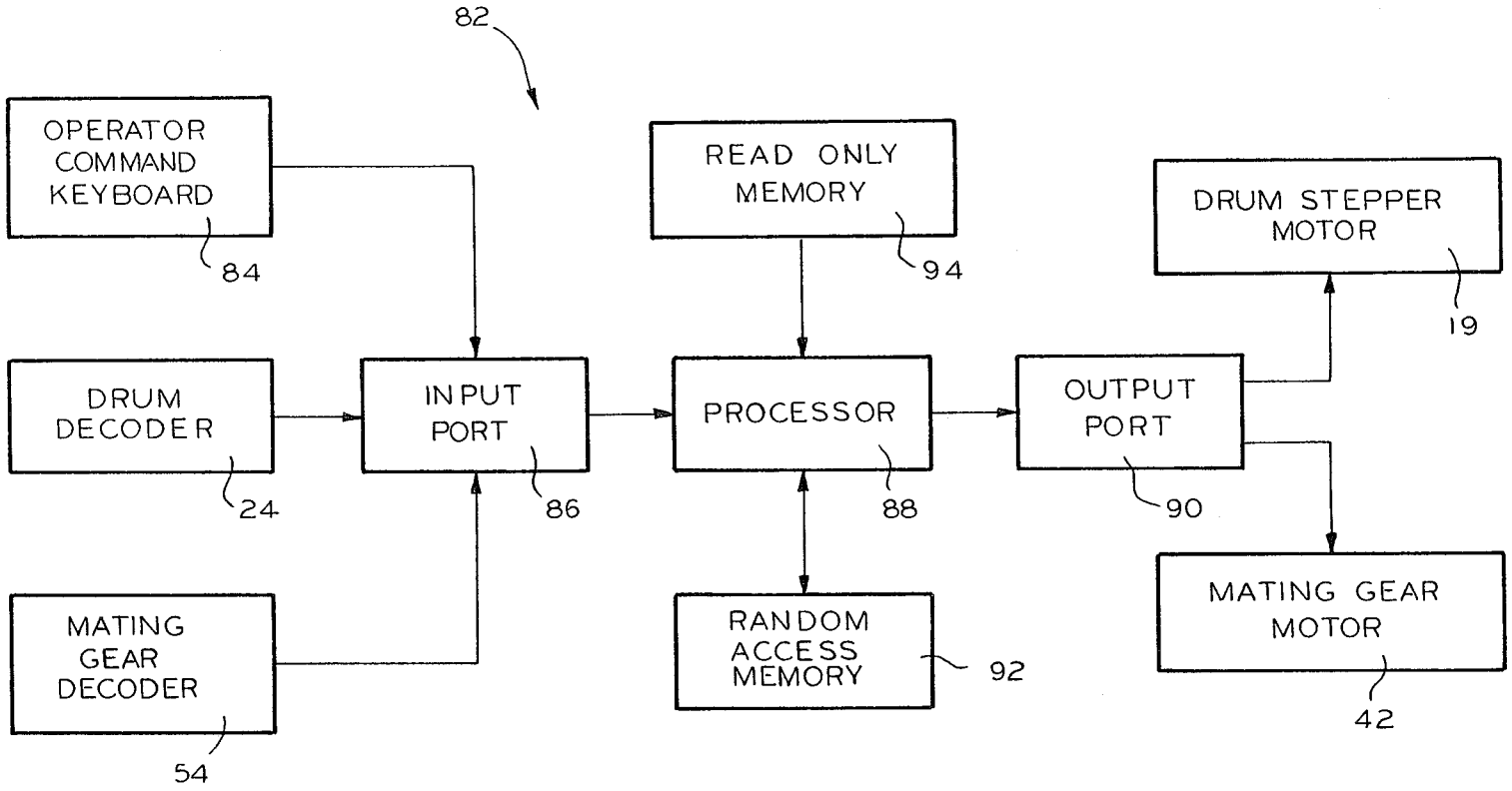
FIG. 7 is a block diagram of control apparatus for the character selection apparatus in accordance with an embodiment of this invention.

A computer control system 82 for the character selection apparatus of this invention is shown in FIG. 7. The control system 82 includes a keyboard 84 or the like for entering operator commands by producing predetermined electrical signals which are related to the specific characters to be printed. Input port 86 processes the signals from the keyboard 84, and signals from the drum decoder 24 and the mating gear decoder 54, and provides input data to a processor 88 such as a microprocessor or the like. The processor 88 provides signals which control an output port 90, and the output port 90 controls the drum stepper motor 19 and the mating gear stepper motor 42.

A random access memory 92 is electrically connected to the processor 88 for storing data, and a programmed read only memory 94 is electrically connected to the processor 88 for providing instructions to the processor 88 so that the motors 19 and 42 are controlled in a desired manner. Many components of the control system 82 need not be placed in the meter 10, and could be included in the postage machine 11, to further reduce the cost of the meter 10.

Essentially, the control system 82 controls the drum and the mating gear so that the print wheels are turned to proper positions and the desired characters are printed when the drum rotates through its print cycle. The control system 82 is capable of automatically rotating the drum for sequential engagement of the mating gear with each of several print wheel gears when necessary, and turning each print wheel to the proper position during engagement.

The control system 82 may be programmed in many ways to facilitate the operation of the apparatus of this invention. For example, the position of each print wheel may be stored in the memory so that the processor can cause the print wheels to be turned to the proper positions by using memory data and data from the mating gear decoder 54 to monitor and control the position of the print wheels. The control system 82 could also be programmed to initialize the print wheels by causing them to be turned to a predetermined position at the beginning of each day, or at the beginning of each execution of an operator command, and to use data from the decoder 54 to set the print wheels properly. Another way to set the print wheels would be to provide a decoder on each print wheel which would provide data to the processor at all times.

The rotary operated control of the print wheels described herein makes it possible to program the control system so that the print wheels are turned in a direction determined by the shortest path between positions. For example, when changing a value print wheel from 9 to 1, the print wheel need not be turned through the positions having characters 8, 7, 6, 5, 4, 3, and 2, but may be turned forward directly to 1.

If the date selection apparatus of FIGS. 5 and 6 is used, the control system 82 should be programmed to sequentially advance the date in response to operator commands, automatically skipping nonexistent dates such as June 31 and the like.

The control system 82 is programmed to control the drum by causing it to turn to preselected positions for engagement of the mating gear with each print wheel gear. When more than one print wheel must be turned, the control system causes the drum to be rotated to as many positions as needed for sequential engagement of the mating gear with each print wheel gear. Only those gears which have to be turned are engaged, and no engagement is needed for repetitious dispensing of postage in equal increments.

In operation, the operator may select a value of postage which is to be dispensed from the meter, or the operator may enter a command to advance the date. The control system sequentially causes the drum to turn to the proper position, and causes each print wheel to rotate to the proper position, as required. If a particular print wheel is already in the desired position, the control system will not adjust that print wheel. When all of the print wheels are in the proper positions, the postage may be dispensed.

The advantages of this invention are now apparent. The cost of the postage meter is reduced because the linear rack mechanism is not needed, eliminating many mechanical parts which are expensive to fabricate and assemble, and the stepper motors and many components of the control system may be located outside of the postage meter, in the postage machine. In addition, the print wheels may be rotated to the selected positions by the shortest path between the existing character and the selected character.

Although in the foregoing specification this invention has been described in relation to certain preferred embodiments thereof, and many details have been set forth for purposes of illustration, it will be apparent to those skilled in the art that the invention is susceptible to additional embodiments, and certain of the details described herein can be varied considerably without departing from the basic principles of the invention.

What is claimed is:

1. An improved postage meter having a rotatable print drum in driven communication with a drive motor assembly, said print drum housing a plurality of print wheel assemblies each print wheel assembly having at least one print wheel having an outside generally cylindrical surface with a plurality of characters in discreet positions on said outside surface, each of said print wheel assemblies having a print wheel gear for selectively positioning said respective print wheel assemblies, so that a selected one of said plurality of characters may be moved to a printing position, a print wheel adjustment assembly for sequentially communicating with said print wheel assemblies, said improvement comprises:

said print wheel adjustment assembly being mounted in said postage meter in fixed location relative to said print drum;

said print drum being rotatable to a plurality of print wheel assembly adjustment positions, each of said adjustment positions bring a respective one of said print wheel gears into engaging contact with said print wheel adjustment assembly;

control means in communication with said drive motor assembly for selectively causing said drive motor assembly to rotate said print wheel assemblies carried by said print drum through said printing position in a printing cycle or to rotatably displace said print drum to any one of said plurality of adjustment positions; and, indexing means for informing said control means when said drive motor assembly has caused said print drum to assume one of said adjustment positions, said indexing means including:

a gear member rotatably mounted in said postage meter and in driven communication with said drive motor assembly such that displacement of said print drum by said drive motor assembly causes a corresponding displacement of said gear member;

a plurality of encoder means fixably mounted to said gear member such that a respective one of said encoder means is placed in communication with a decoder means when said gear member is placed in a position corresponding to a respective one of said adjustment positions of said print drum; and a decoder means fixably mounted in said postage meter for cooperating with said encoder means and producing electrical signals indicative of the location of said print drum in a particular one of said adjustment positions and communicating the position of said print drum to said control means.

2. An improved postage meter as claimed in claim 1 further comprising means for causing said decoder to communicate with said control means in a characteristically unique manner depending upon which of said encoders is in communication with said decoder means.

* * * * *